US005139112A

United States Patent [19]

Tonna et al.

[11] Patent Number: 5,139,112

[45] Date of Patent: Aug. 18, 1992

[54] ELEVATOR CAR DOOR LOCK

[75] Inventors: Christian G. Tonna, New Britain; Richard E. Kulak, Bristol, both of Conn.

[73] Assignee: Otis Elevator Company, Farmington, Conn.

[21] Appl. No.: 607,439

[22] Filed: Oct. 31, 1990

[51] Int. Cl.[5] ..... B66B 13/00

[52] U.S. Cl. ..... 187/57; 187/61; 49/116

[58] Field of Search ..... 187/49, 57, 61, 60, 187/52 LC, 56, 57, 51; 49/116, 404

[56] References Cited

U.S. PATENT DOCUMENTS

| | | | |
|---|---|---|---|
| 4,364,454 | 12/1982 | Glaser et al. | 187/57 |
| 4,926,974 | 5/1990 | Inventio | 187/52 LC |
| 4,926,976 | 5/1990 | Inventio | 187/57 |
| 4,934,488 | 6/1990 | Mitsubishi | 187/57 |

FOREIGN PATENT DOCUMENTS

| | | | |
|---|---|---|---|
| 59443 | 5/1977 | Japan | 187/61 |
| 247389 | 10/1989 | Japan | 187/57 |

*Primary Examiner*—Robert P. Olszewski
*Assistant Examiner*—Kenneth Noland
*Attorney, Agent, or Firm*—Lloyd D. Doigan

[57] ABSTRACT

An elevator door system utilizes a cam to unlatch hoistway doors. The cam is required by code to have a greater swing motion than is required to unlock the hoistway doors. A mechanism follows the motion of the cam and locks the car doors when the cam is beyond the swing motion required to actuate a hoistway door lock. If the cam operates within the normal swing motion, it is in contact with a hoistway door lock. If the retiring cam is not in contact with the hoistway door lock, the car must not be a safe exiting zone and the car door is locked by the mechanism.

5 Claims, 4 Drawing Sheets

ELEVATOR CAR DOOR LOCK

TECHNICAL FIELD

This invention relates to elevators and more particularly to an elevator car door lock.

BACKGROUND ART

It is required to equip the car doors of an elevator with a lock. The lock prevents the car doors from opening if the car is not at a position in a hoistway to allow passengers to exit the car safely.

U.S. Pat. No. 4,934,488 entitled "Door Lock For An Elevator Car" to Umemura, shows a door lock which interacts with cam surfaces placed on a surface of the elevator hoistway. The lock may also be activated by a solenoid 44. The hardware required is expensive to manufacture, install and maintain.

Accordingly, a new car door lock is sought.

DISCLOSURE OF THE INVENTION

It is an object of the invention to provide a car door lock which is simple to manufacture, install and maintain. According to the invention, an elevator door system which utilizes a cam to unlock hoistway doors is required by code to have a greater swing motion than is required to unlock the hoistway doors. A mechanism follows the motion of the cam and locks the car doors when the cam is beyond the swing motion required to actuate a hoistway door lock. If the cam is within the normal swing motion, the cam is in contact with the hoistway door lock. If the cam is not in contact with the hoistway door lock, the car must not be a safe passenger exit area and the mechanism will lock the car door.

According further to the invention, the mechanism consists of a cam which operates a linkage and a locking tab to lock and unlock the car doors.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
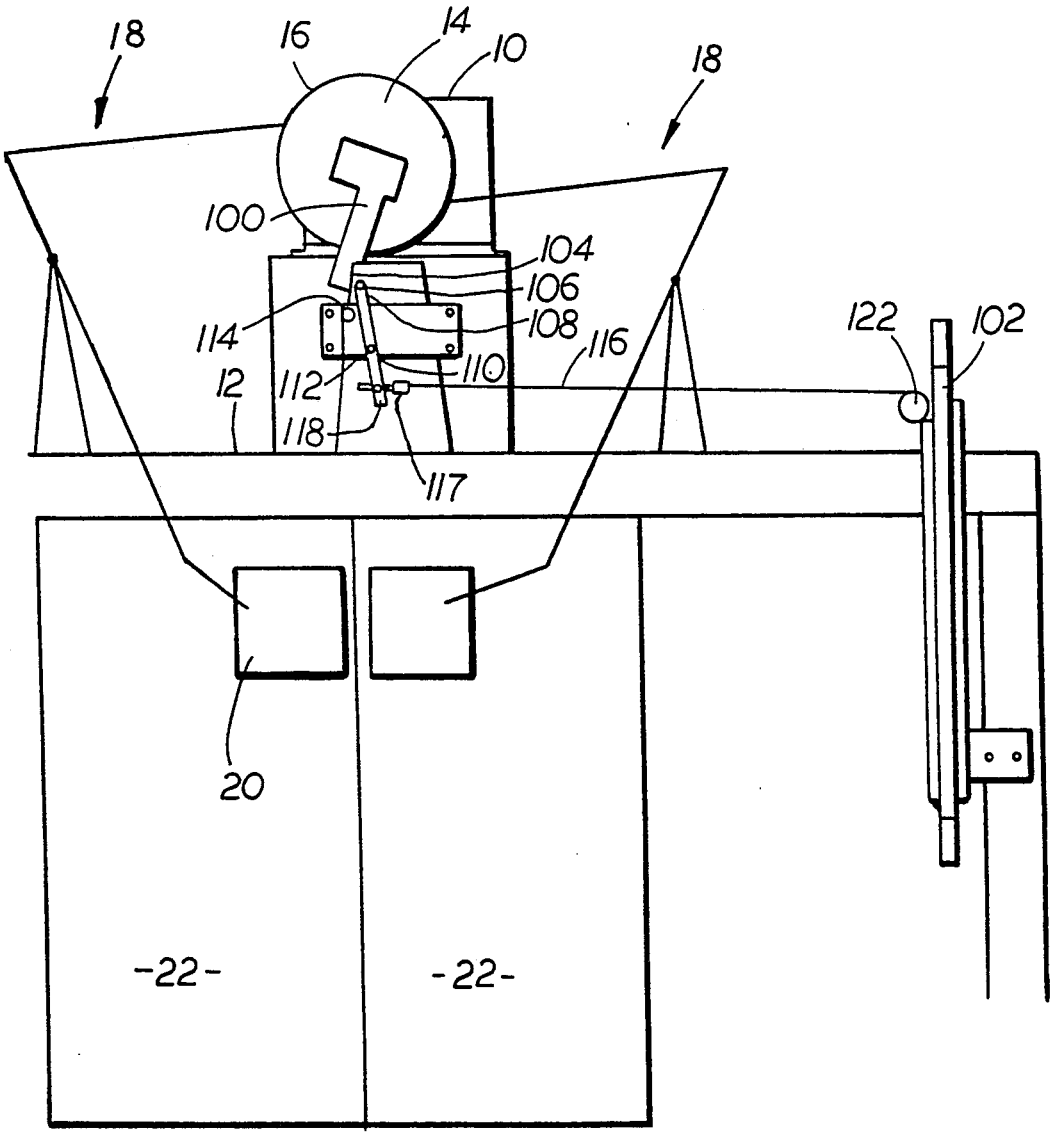
FIG. 1 shows a plan view, partly in perspective, and partly in schematic form, of an elevator door system embodying the invention.

Referring to FIG. 1, an embodiment of the invention is shown. A bi-directional motor 10 is mounted, by conventional means, atop an elevator car 12. The motor has an output sheave 14 which is attached at its outer periphery thereof to a pair of linkages 18. Each linkage attaches by means of a coupling device 20 to a car door 22.

A strike arm 100 is fixedly attached, by conventional means, to the output sheave 14 to rotate therewith. The strike arm controls the motion of a retiring cam 102 to lock and unlock the hoistway doors 136 (see FIGS. 2 and 3) as will be discussed infra.

The strike arm 100 has a cam surface 104 for engaging a first roller 106 which is attached to a first end of a lever 108. The lever rotates about an axle 112. A stop 114 limits the motion of the first roller to control the motion of the retiring cam as will be discussed infra.

A cable 116 attaches to a second end 118 of the lever 108 via an adjustment screw 117. The cable extends about an idler pulley 122 mounted to atop the elevator car. The idler pulley directs the cable downwardly where it attaches to the retiring cam 102.

Figure 2:
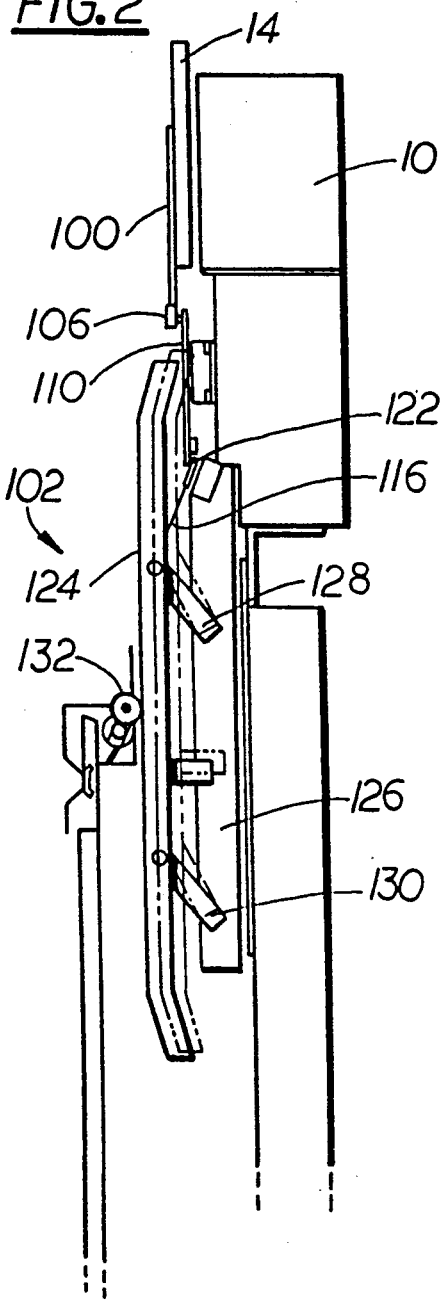
FIG. 2 is a side view of a retiring cam of FIG. 1.
Figure 3:
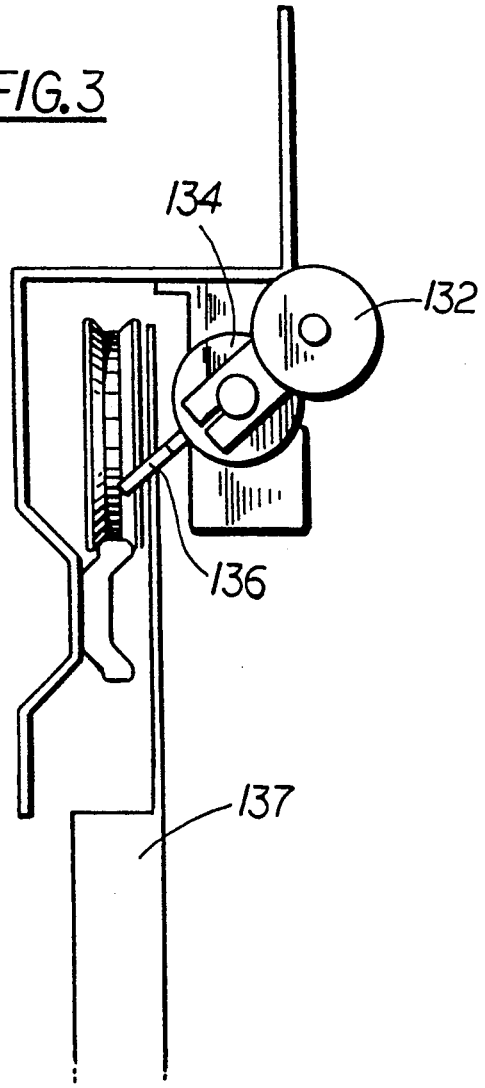
FIG. 3 is an expanded view of a portion of FIG. 2.

The retiring cam, as shown in FIG. 2 and as known in the art, consists of a parallelogram having a vertical first leg 124, a second leg 126 parallel to the first leg, an upper leg 128 and a lower leg 130. The cable attaches to the first leg by conventional means.

As the strike arm 100 rotates in a clockwise direction with the operation of the motor 10, the first roller 106 moves in a counterclockwise direction along the cam surface 104 of the strike arm causing the cable 116 to lower the retiring cam into the position shown in FIG. 2. The retiring cam engages a second roller 132 which, via shaft 134 rotates a first locking tab 136 to unlock a hoistway door 137.

Figure 4:
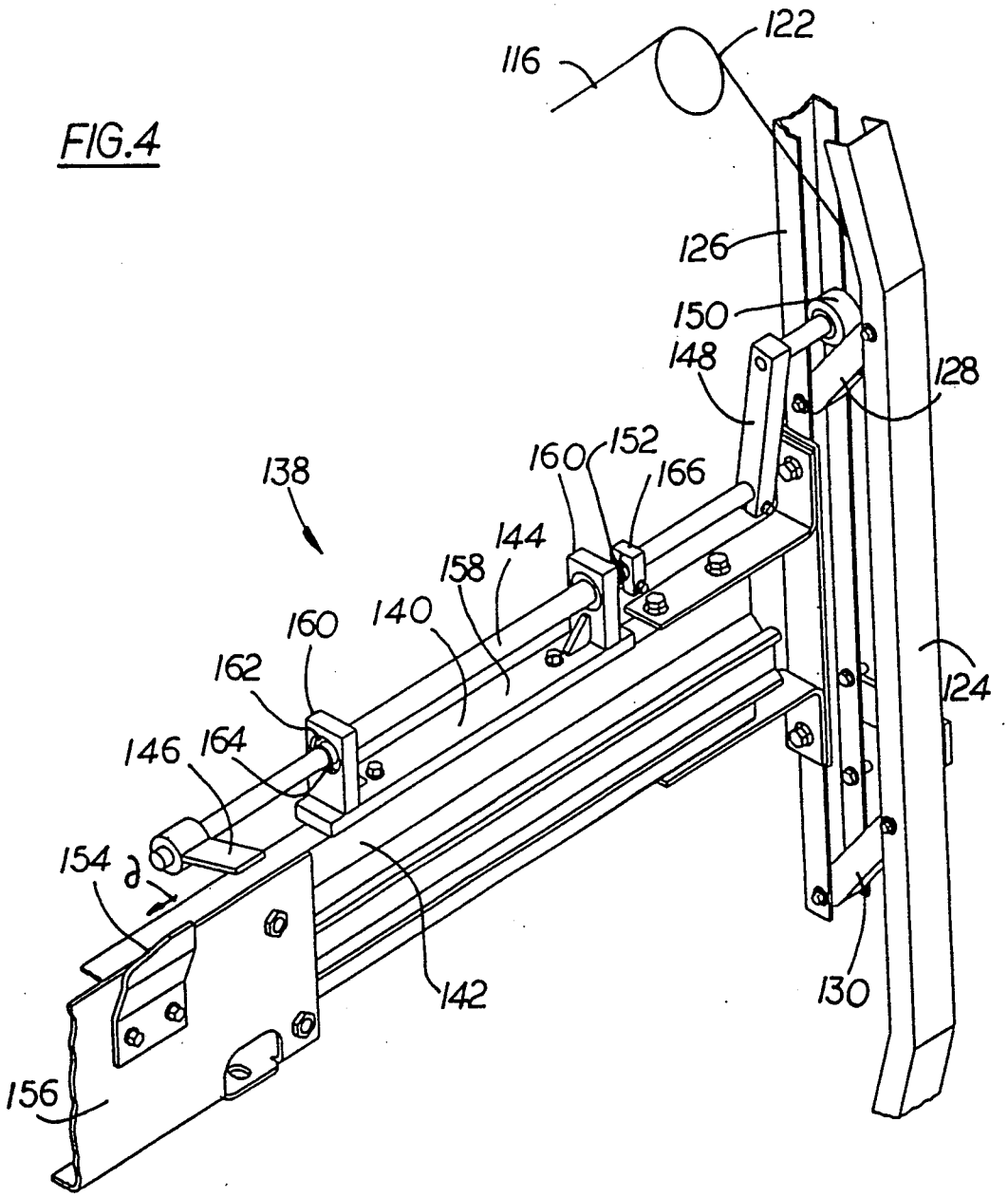
FIG. 4 is a perspective view of an embodiment of a door lock of the invention.

Referring to FIG. 4, the car door lock 138 consists of a base 140 attached to a car header 142 atop the elevator car 12, a shaft 144 rotatably mounted within the base, a second locking tab 146 fixedly attached to one end of the shaft, a lever 148 fixedly attached to the other end of the shaft, a third roller 150 rotatably mounted to the lever and riding on the upper leg 128 of the retiring cam, and a backlash spring 152. A locking bracket is mounted on a car door hanger 156. The second locking tab is set at a distance d from the bracket in the direction of opening.

The base 140 consists of a flat plate 158, which is bolted to the car door header 142, and a pair of brackets 160 extending upwardly therefrom. Each bracket has an opening 162 housing a bearing 164. The bearings are adapted to rotatably receive the shaft 144. The backlash spring 152 is fixedly attached to one bracket and fixedly attached to the shaft by means of clamp 166.

Figure 5:
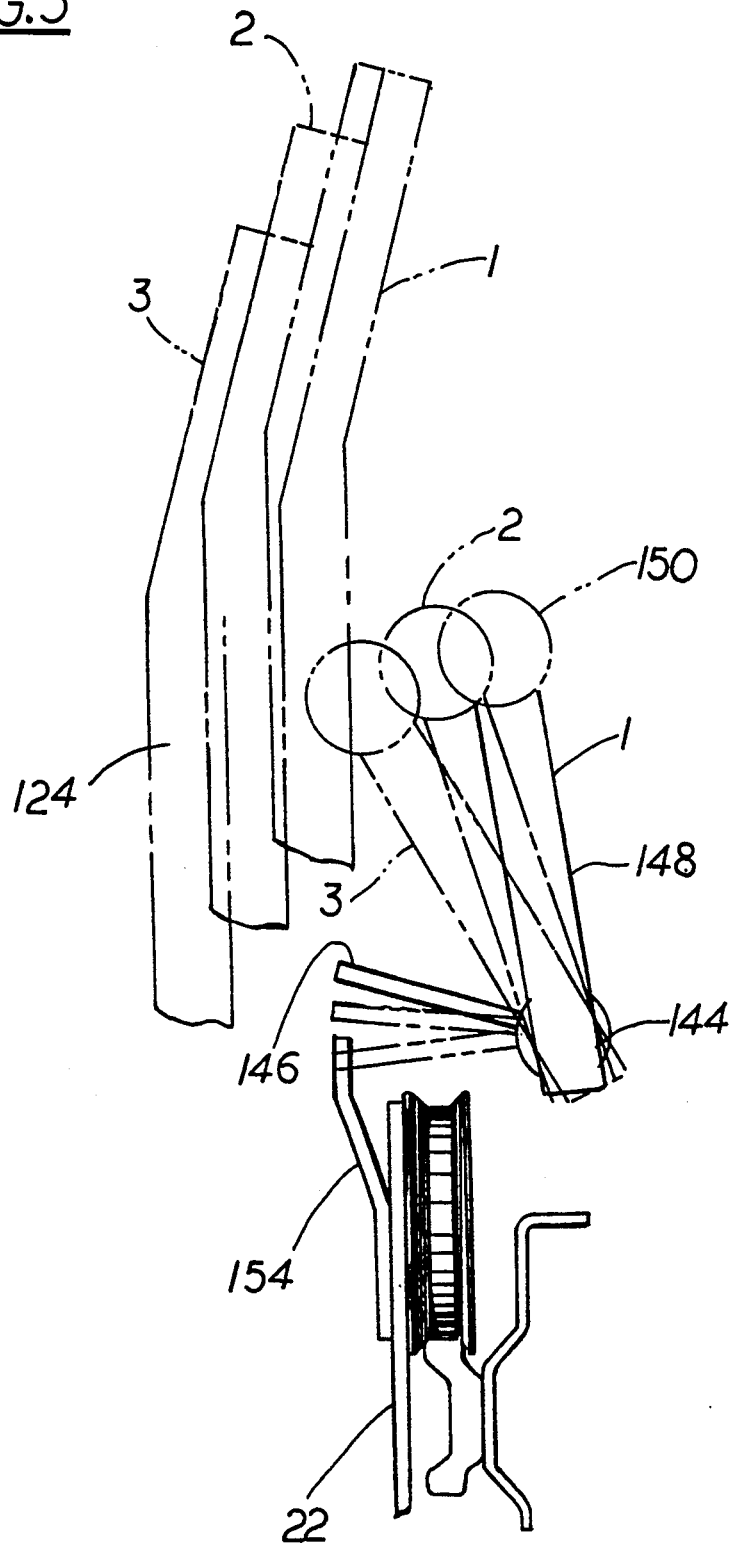
FIG. 5 is a side view, partially in phantom of the operation of the door lock of FIG. 4.

Referring now to FIG. 5, operation of the cam lock 138 is shown. In phantom position 1, the car 12 is running up and down the hoistway (not shown). The first leg 124 of the retiring cam 102 is normally kept in an upper, retracted position such that the second locking tab 146 (via roller 150, which follows the upper leg 128 of the retiring cam, lever 148 and shaft 144) does not interfere with the motion of the car door locking bracket 154. As such, the car doors are not locked.

In the second phantom position 2, the car 12 is at a landing (not shown). When the retiring cam operates 102, the first leg 124 is lowered to a position where it contacts the second roller 132 of a hoistway door lock (see FIGS. 2 and 3). As the hoistway door lock only allows the retiring cam to move to the position shown, the car doors are free to open. The second locking tab 146 does not interfere with the lock bracket 154.

As shown in the phantom position 3, the car 12 is outside a landing zone. If a passenger tries to open the car doors, the motion of the car doors drives the motor 10 via the linkages 18. The motor lowers the first leg 124 of the retiring cam 102 via the cable 116. The retiring cam descends to the position shown as phantom position 3 because the retiring cam does not contact the second roller of the hoistway door lock. The retiring cam is fully down, beyond the stroke required to operate the hoistway door lock, as may be required by code. The third roller 150 follows the path of the upper leg 128 thereby rotating the shaft 144 and the second locking tab 146 such that the second locking tab interferes with the lock bracket 154 on the car doors 22. The car doors are now locked.

Because the car door lock utilizes hardware, such as the hoistway door lock, which already exists within the elevator, the car door lock is simple to install. Because the car door lock utilizes the motion of the existing retiring cam, operation is simple and energy efficient. Because the car door lock consists essentially of a one piece linkage, the car door lock is simple to maintain and install.

While the present invention has been illustrated and described with respect to a particularly preferred embodiment thereof, it will be appreciated by those skilled in the art that various other changes, omissions, and additions in the form and detail thereof may be made therein without departing from the spirit and scope of the invention. One of ordinary skill will appreciate, for instance that the hoistway and car door lock systems may be reversed. One of ordinary skills in the art will also appreciate that the system may be utilized in other inner and outer door systems such as shuttles.

We claim:

1. A lock for an elevator car door, said lock comprising:

a hoistway door lock, a cam for unlocking said hoistway door lock, said cam having a first range of motion for unlocking said hoistway door lock and a second range of motion beyond the first range of motion required to unlock said hoistway door, means for locking said car door, said means following said cam along said first and second range of motion, said means not locking said car door when said cam is within said first range of motion and locking said door when said cam is within said second range of motion.

2. The lock of claim 1 wherein said means for locking comprises:

a rotatable linkage engaging said cam for motion therewith, and a lock attaching to said linkage for interfering with motion of said car door.

3. Method of locking doors for a door system having inner and outer doors, the door system having a first door lock for one of said inner and outer doors, said first door lock having a cam having a first range of motion for unlocking said door lock and a second range of motion beyond the first range of motion required to unlock said door, said door system having a second lock for unlocking or unlocking the other of said inner or outer doors, said method comprising:

following the movement of said cam by said second door lock, locking said other of said inner or outer doors if said cam moves into said second range of motion.

4. A lock for use with an elevator car door and with an hoistway door lock, said lock comprising:

a cam for unlocking said hoistway door lock, said cam having a first range of motion for unlocking said hoistway door lock and a second range of motion beyond the first range of motion required to unlock said hoistway door, means for locking said car door, said means following said cam along said first and second range of motion, said means not locking said car door when said cam is within said first range of motion and locking said door when said cam is within said second range of motion.

5. A lock for use with one of an inner and outer door system, an other of said inner and outer door having a door lock, said lock comprising:

a cam for unlocking said door lock, said cam having a first range of motion for unlocking said door lock and a second range of motion beyond the first range of motion required to unlock said door lock, means for locking said one of an inner and outer doors, said means following said cam along said first and second range of motion, said means not locking said one of said inner and outer doors when said cam is within said first range of motion and locking said one of said inner and outer doors when said cam is within said second range of motion.

* * * * *